US007841095B1

(12) United States Patent
Board

(10) Patent No.: US 7,841,095 B1
(45) Date of Patent: Nov. 30, 2010

(54) DRAFTING APPARATUS

(76) Inventor: Anthony J. Board, 7535 Kilbarron Ct., Indianapolis, IN (US) 46217

( * ) Notice: Subject to any disclaimer, the term of this patent is extended or adjusted under 35 U.S.C. 154(b) by 83 days.

(21) Appl. No.: 12/407,483

(22) Filed: Mar. 19, 2009

(51) Int. Cl.
*B43L 7/12* (2006.01)
*B43L 13/02* (2006.01)

(52) U.S. Cl. ..... 33/470; 33/479

(58) Field of Classification Search ..... 33/470, 33/479, 418–422, 424–427, 452, 456, 459, 33/460, 464, 465
See application file for complete search history.

(56) References Cited

U.S. PATENT DOCUMENTS

| | | | | | |
|---|---|---|---|---|---|
| 70,547 | A | * | 11/1867 | Graham | 33/419 |
| 759,319 | A | * | 5/1904 | Schumacher | 33/461 |
| 847,720 | A | * | 3/1907 | Barbo | 33/462 |
| 1,053,757 | A | | 2/1913 | Tucker | |
| 1,205,687 | A | * | 11/1916 | Verhey et al. | 33/462 |
| 1,524,392 | A | | 7/1923 | East | |
| 2,549,403 | A | * | 4/1951 | Weinberg, Jr. | 33/446 |
| 2,770,043 | A | * | 11/1956 | Kwiecinski | 33/452 |
| 3,103,747 | A | * | 9/1963 | De La Sierra | 33/426 |
| 3,380,166 | A | * | 4/1968 | Hoyle | 33/446 |
| 3,635,396 | A | * | 1/1972 | Palfi | 235/70 R |
| 3,688,409 | A | | 9/1972 | Robers | |
| 3,718,980 | A | * | 3/1973 | Poulos | 33/526 |
| 3,991,474 | A | | 11/1976 | Rath | |
| 4,525,933 | A | | 7/1985 | Patterson | |
| D305,873 | S | * | 2/1990 | Bisson | D10/62 |
| 5,205,045 | A | * | 4/1993 | Liu | 33/468 |
| 5,446,969 | A | * | 9/1995 | Terenzoni | 33/419 |
| 5,701,680 | A | * | 12/1997 | Garcia et al. | 33/526 |
| 6,260,283 | B1 | * | 7/2001 | Abernathy et al. | 33/419 |
| 6,510,616 | B1 | * | 1/2003 | Sparkman | 33/460 |
| 7,159,328 | B1 | * | 1/2007 | Duda | 33/647 |
| 2006/0283032 | A1 | * | 12/2006 | Yang | 33/419 |

* cited by examiner

*Primary Examiner*—Yaritza Guadalupe-McCall
(74) *Attorney, Agent, or Firm*—Crossley Patent Law; Mark A. Crossley

(57) ABSTRACT

The drafting apparatus has only three parts which are the permanently attached first head and blade, the adjustably attached second head, and the thumb screw. The apparatus quickly adjusts to a given surface. If secure attachment is desired, the thumb screw is tightened against the blade to position the second head firmly against a side of the surface opposite the first head. If desired, the second head is easily completely removed, to aid a draftsperson in a given task. The apparatus is not confined to use only on a drafting table. The transparent bevels provide visual access to indicia under part of the blade. The relatively long length of the elongated slot provides for fit to even narrow drawing surfaces.

9 Claims, 4 Drawing Sheets

DRAFTING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

In drafting, the use of a T-square is common. When using a T-square, though, one hand must be kept on the square in order to stabilize and prevent movement. This becomes especially difficult when an angle must be created with other drafting tools, a 75 degree angle for example. The use of a triangle or even two triangles and the T-square becomes awkward at best. Other difficulties are encountered when the T-square is used to make vertical lines. The present apparatus provides a selectively secured T-square which solves the above noted problems.

FIELD OF THE INVENTION

The drafting apparatus relates to drafting tools and more especially to a T-square having one secure head and one selectively and adjustably positioned head.

SUMMARY OF THE INVENTION

The general purpose of the drafting apparatus, described subsequently in greater detail, is to provide a drafting apparatus which has many novel features that result in an improved drafting apparatus which is not anticipated, rendered obvious, suggested, or even implied by prior art, either alone or in combination thereof.

To attain this, the drafting apparatus is comprised of only three parts, consisting of the permanently attached first head and blade, the adjustably attached second head, and the thumb screw. The apparatus quickly adjusts to a given surface. If secure attachment is desired, the thumb screw is tightened against the blade to position the second head firmly against a side of the surface opposite the first head. If desired, the second head is easily completely removed, to aid a draftsperson in a given task. The apparatus is not confined to use only on a drafting table. Additionally, the second head of the apparatus can be secured at an angle, as desired, for work on a surface which is not perpendicularly true. The transparent bevels provide visual access to indicia under part of the blade. The relatively long length of the elongated slot provides for fit to even narrow drawing surfaces.

Thus has been broadly outlined the more important features of the improved drafting apparatus so that the detailed description thereof that follows may be better understood and in order that the present contribution to the art may be better appreciated.

An object of the drafting apparatus is to enable a draftsperson to draw lines without having to support a T-square.

Another object of the drafting apparatus is to fit a variety of drawing surfaces.

A further object of the drafting apparatus is to adjust to a given surface quickly.

An added object of the drafting apparatus is to be comprised of only three parts.

These together with additional objects, features and advantages of the improved drafting apparatus will be readily apparent to those of ordinary skill in the art upon reading the following detailed description of presently preferred, but nonetheless illustrative, embodiments of the improved drafting apparatus when taken in conjunction with the accompanying drawings.

In this respect, before explaining the current embodiments of the improved drafting apparatus in detail, it is to be understood that the drafting apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved drafting apparatus. It is therefore important that the claims be regarded as including such equivalent constructions insofar as they do not depart from the spirit and scope of the drafting apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the drafting apparatus generally designated by the reference number 10 will be described.

Figure 1:
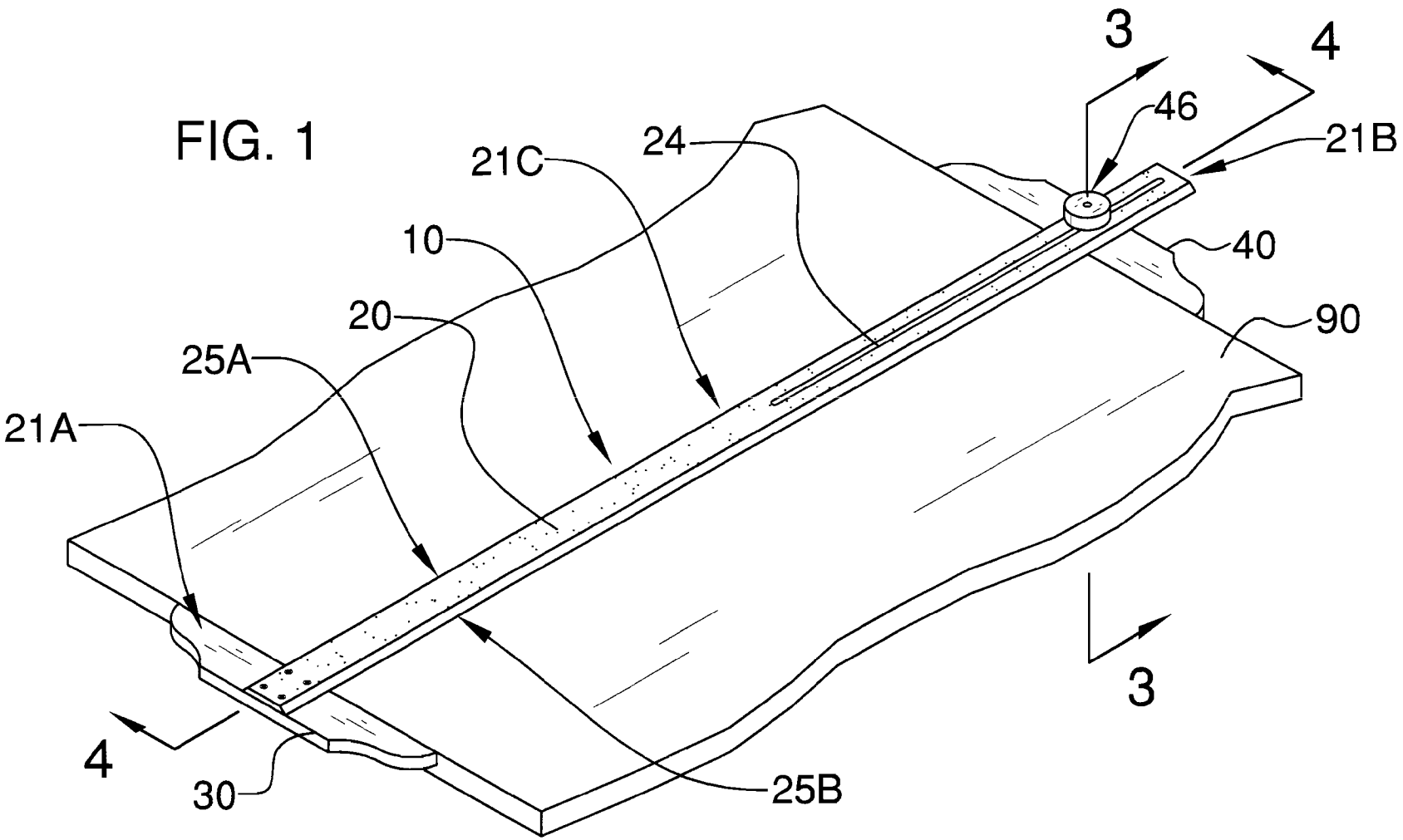
FIG. 1 is a perspective view of the apparatus in use on a drafting table.

Referring to FIG. 1, the drafting apparatus 10 is in use on a typical drafting table 90. The first head 30 abuts one side of the drafting table 90. The second head 40 is adjustably positioned via the thumb screw 46 to selectively hold the blade 20 in a desired position on a given drawing surface, such as the drafting table 90.

Figure 6:
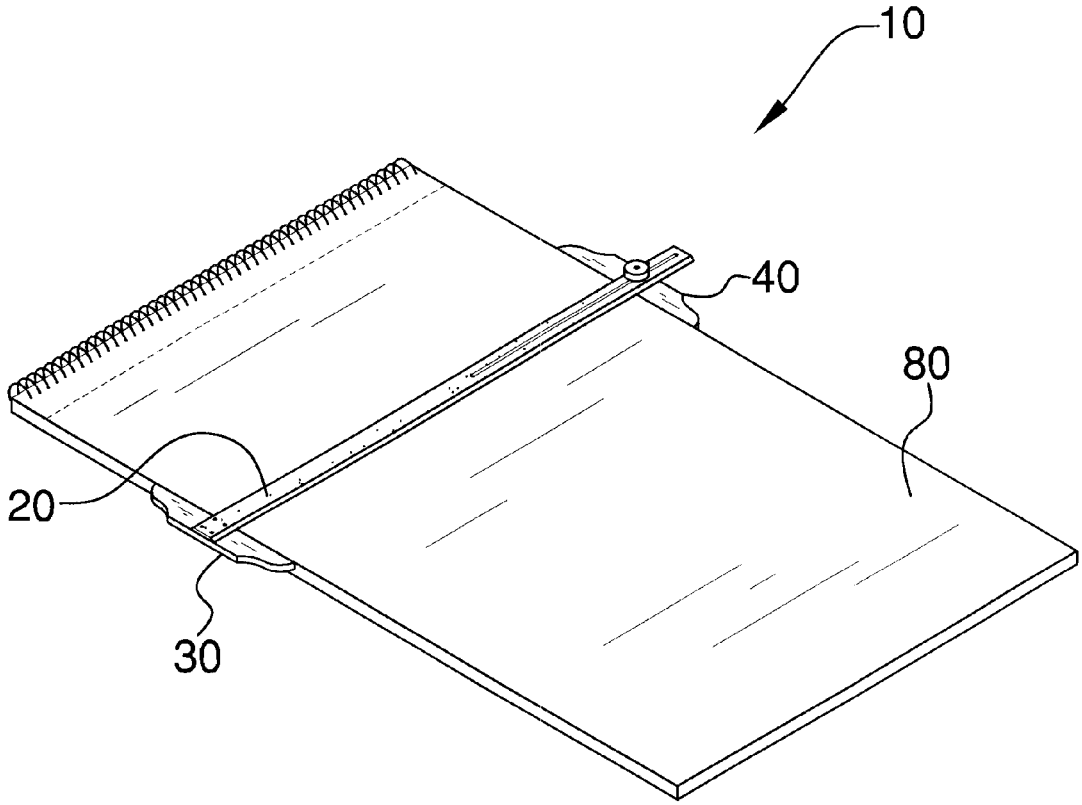
FIG. 6 is a perspective view of the apparatus in use on a drawing tablet.

Referring to FIG. 6, the apparatus 10 is not confined to use on a drafting table 90 but can be used with a drawing tablet 80 or other desired device or surface. It is important to note that the apparatus 10 is freely moved from one surface to another, without need of attachment.

Figure 2:
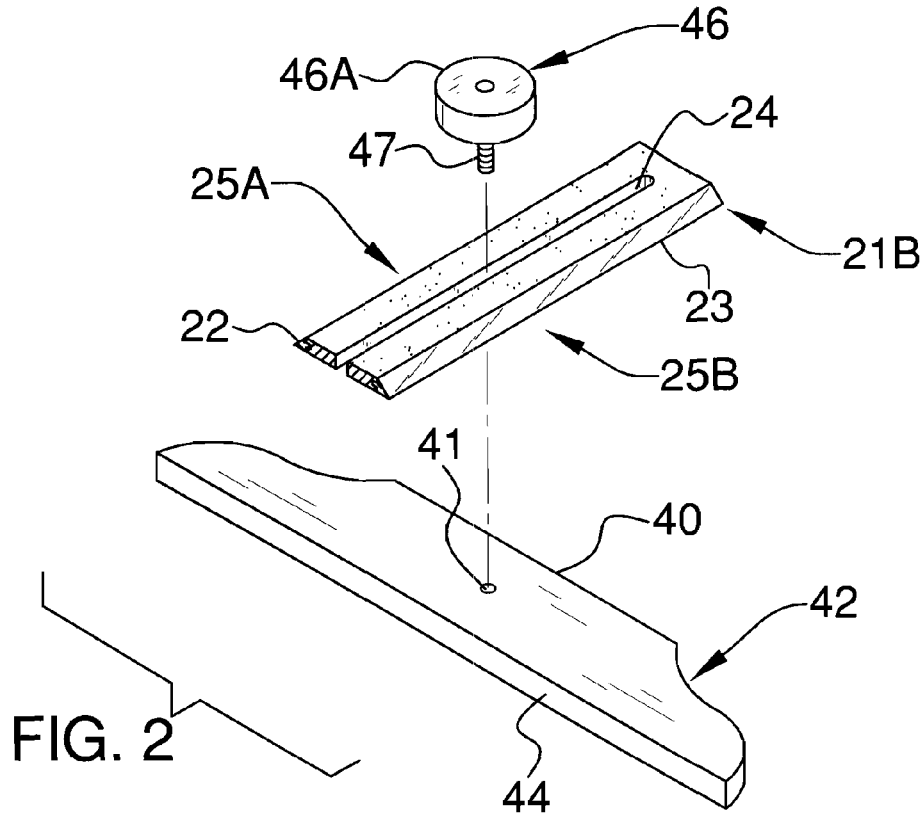
FIG. 2 is a perspective view of the blade second end and the second head.
Figure 5:
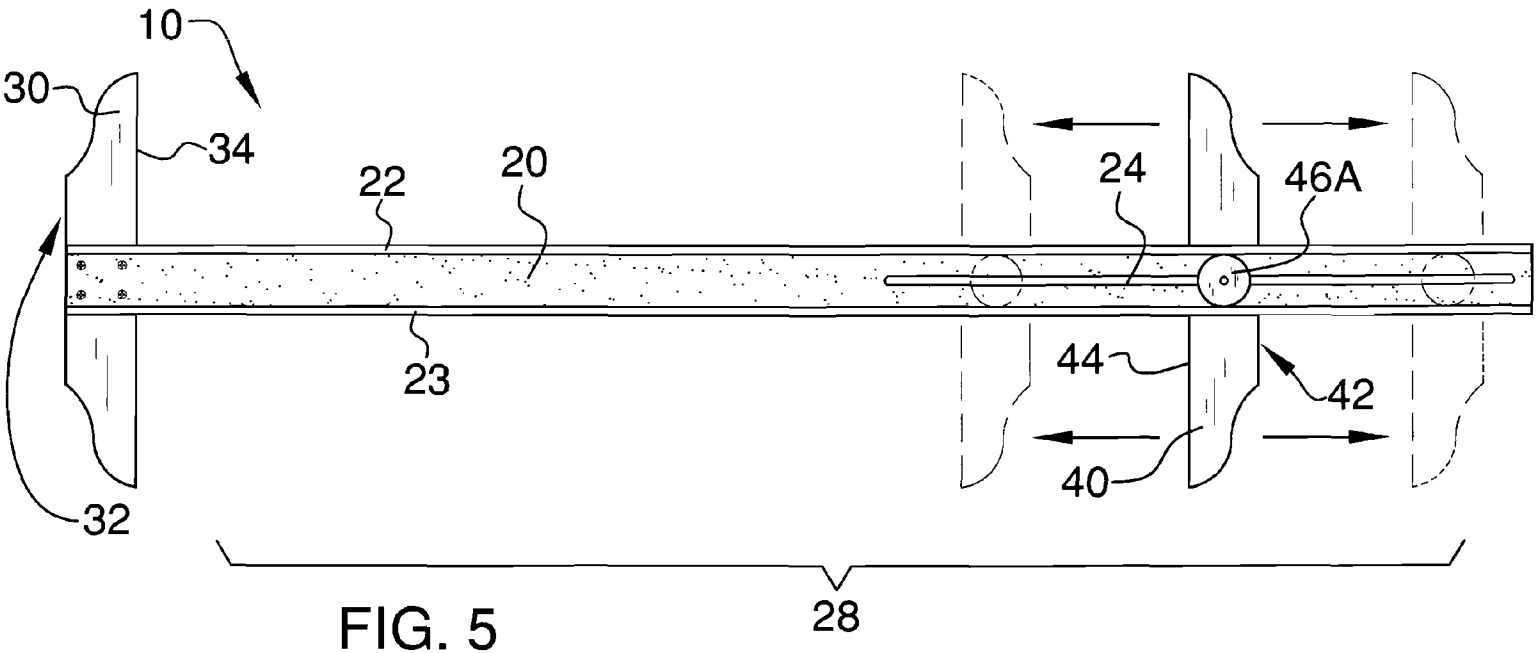
FIG. 5 is a top plan view.

Referring to FIGS. 1, 2, and 5, the apparatus 10 comprises, in combination, the blade 20 having a first end 21*a*, a second end 21*b*, and a length therebetween. The blade 20 further comprises the elongated slot 24. The elongated slot 24 is extended from proximal to the blade 20 center 21*c* to proximal to the blade second end 21*b*.

Figure 3:
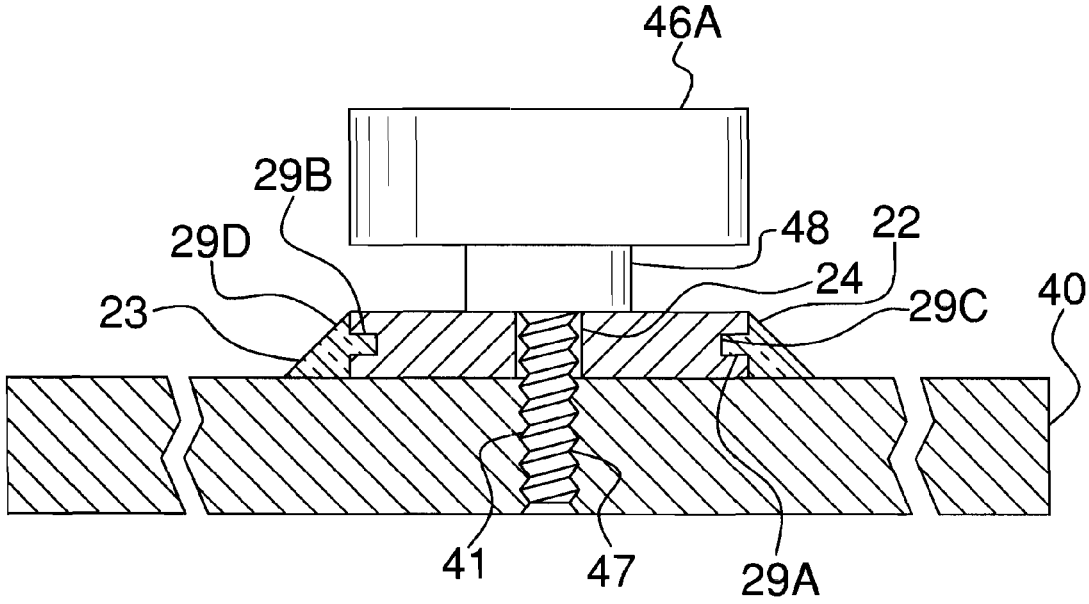
FIG. 3 is a partial cross sectional view of FIG. 1, taken along the line 3-3.

Referring to FIG. 3, first notch 29*c* is disposed within the first side 25*a* of the blade 20. The second notch 29*d* is disposed within the second side 25*b* of the blade 20. Both bevels are transparent to aid in sight of various indicia on a drawing surface. The bevels comprise the first transparent bevel 22 and the second transparent bevel 23. The first transparent bevel 22 has a horizontally disposed first bevel tooth 29*a*. The first transparent bevel 22 first bevel tooth 29*a* is fitted to the first side 25*a* first notch 29*c*. The second transparent bevel 23 has a horizontally disposed second bevel tooth 29*b*. The second transparent bevel 23 second bevel tooth 29*b* is fitted to the second notch 29*d*.

Figure 4:
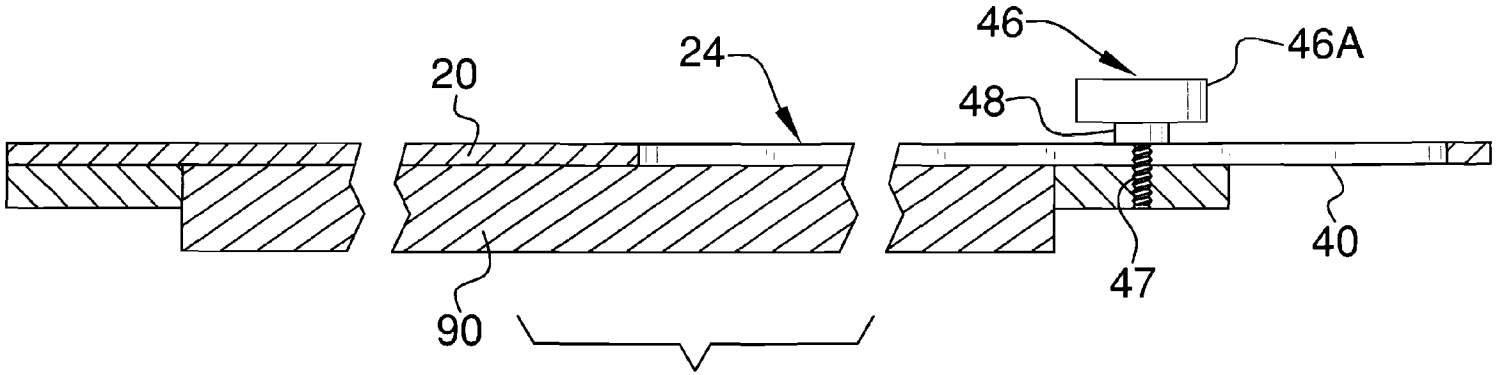
FIG. 4 is a partial cross sectional view of FIG. 1, taken along the line 4-4.

Referring again to FIGS. 1 and 5 and also to FIG. 4, the first head 30 is perpendicularly affixed to the first end 21*a* of the blade 20. The first head 30 has a sculpted outer edge 32 spaced apart from a straight inner edge 34. The second head 40 is slideably and selectively affixed to the elongated slot 24 of the blade 20. The second head 40 comprises a second sculpted outer edge 42 spaced apart from a second straight inner edge 44. The second head 40 is identical to the first head 30 with the exception of selective attachment of the first head to the blade 20. The second head 40 further comprises the threaded orifice 41 in a center of the second head 40.

Referring to FIGS. 2 and 3, the thumb screw 46 has a round top 46*a* disposed above the reduced diameter shoulder 48. The thread 47 is disposed below the shoulder 48. The thread 47 is selectively received by the threaded orifice 41 of the second head 40. The blade 20 is abutted by the shoulder 48 in selectively retaining the second head 40 to the blade 20 in a desired position.

With respect to the above description then, it is to be realized that the optimum dimensional relationships for the parts of the drafting apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the drafting apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the drafting apparatus may be used.

Therefore, the foregoing is considered as illustrative only of the principles of the drafting apparatus. Further, since numerous modifications and changes will readily occur to those skilled in the art, it is not desired to limit the drafting apparatus to the exact construction and operation shown and described, and accordingly, all suitable modifications and equivalents may be resorted to, falling within the scope of the drafting apparatus.

What is claimed is:

1. A drafting apparatus, comprising, in combination:

a blade having a first end, a second end, and a length therebetween, the blade further comprising:

a first notch within a first side of the blade;

a second notch within a second side of the blade;

a first bevel having a horizontally disposed first bevel tooth, the first bevel first bevel tooth fitted to the first side first notch;

a second bevel having a horizontally disposed second bevel tooth, the second bevel second bevel tooth fitted to the second notch;

a first head perpendicularly affixed to the first end of the blade, the first head having a sculpted outer edge spaced apart from a straight inner edge;

a second head selectively and positionably affixed along the length of the blade, the second head comprising a second sculpted outer edge spaced apart from a second straight inner edge.

2. The apparatus according to claim 1 wherein the first bevel is further transparent.

3. The apparatus according to claim 2 wherein the second bevel is further transparent.

4. The apparatus according to claim 3 wherein the second head is further selectively affixed to the blade at an angle other than perpendicular.

5. The apparatus according to claim 2 wherein the second head is further selectively affixed to the blade at an angle other than perpendicular.

6. The apparatus according to claim 1 wherein the second bevel is further transparent.

7. The apparatus according to claim 6 wherein the second head is further selectively affixed to the blade at an angle other than perpendicular.

8. The apparatus according to claim 1 wherein the second head is further selectively affixed to the blade at an angle other than perpendicular.

9. A drafting apparatus, comprising, in combination:

a blade having a first end, a second end, and a length therebetween, the blade further comprising:

an elongated slot extended from proximal to a blade center to proximal to the blade second end;

a first notch within a first side of the blade;

a second notch within a second side of the blade;

a first transparent bevel having a horizontally disposed first bevel tooth, the first transparent bevel first bevel tooth fitted to the first side first notch;

a second transparent bevel having a horizontally disposed second bevel tooth, the second transparent bevel second bevel tooth fitted to the second notch;

a first head perpendicularly affixed to the first end of the blade, the first head having a sculpted outer edge spaced apart from a straight inner edge;

a second head slideably and selectively affixed to the elongated slot of the blade, the second head affixed to the blade at a desired angle, the second head comprising:

a second sculpted outer edge spaced apart from a second straight inner edge;

a threaded orifice in a center of the second head;

a thumb screw having a round top above a reduced diameter shoulder, a thread below the shoulder, the thread selectively received by the threaded orifice of the second head, the blade abutted by the shoulder in selectively and positionably retaining the second head to the blade.

* * * * *